US006067694A

United States Patent [19]

Candotti

[11] Patent Number: 6,067,694

[45] Date of Patent: May 30, 2000

[54] PRESS-STUD

[75] Inventor: Riccardo Candotti, Padova, Italy

[73] Assignee: Cobra Trade S.A., Luxembourg, Luxembourg

[21] Appl. No.: 09/051,493

[22] PCT Filed: Oct. 14, 1996

[86] PCT No.: PCT/EP96/04464

§ 371 Date: Apr. 13, 1998

§ 102(e) Date: Apr. 13, 1998

[87] PCT Pub. No.: WO97/15207

PCT Pub. Date: May 1, 1997

[30] Foreign Application Priority Data

Oct. 20, 1995 [IT] Italy ..... PD950087 U
Mar. 4, 1996 [IT] Italy ..... PD960013 U

[51] Int. Cl.[7] ..... A44B 1/26; A44B 1/42

[52] U.S. Cl. ..... 24/662; 24/108; 24/104; 24/453

[58] Field of Search ..... 24/662, 621, 618, 24/324, 663, 297, 197, 108, 107, 104, 453

[56] References Cited

U.S. PATENT DOCUMENTS

| | | | |
|---|---|---|---|
| 1,697,833 | 1/1929 | Lane | 24/197 |
| 3,083,430 | 4/1963 | Shears | 24/662 |
| 3,643,296 | 2/1972 | Kahn | 24/108 |
| 4,531,870 | 7/1985 | Moryl et al. | 24/453 |
| 5,050,279 | 9/1991 | Nemazi et al. | 24/662 |
| 5,113,553 | 5/1992 | Hutchinson | 24/108 |

FOREIGN PATENT DOCUMENTS

| | | | |
|---|---|---|---|
| 1597718 | 6/1970 | France . | |
| 0676782 | 8/1952 | United Kingdom | 24/662 |
| 724609 | 2/1955 | United Kingdom . | |
| 0867888 | 5/1961 | United Kingdom | 24/108 |
| 8902230 | 3/1989 | WIPO . | |

*Primary Examiner*—Victor N. Sakran
*Attorney, Agent, or Firm*—Daniel O'Byrne

[57] ABSTRACT

A press-stud comprising a female part (11; 317) to which one end (14; 318) of a male part (15; 330) is anchored in the closed configuration by forcing with elastic deformation of a ring (12; 100; 200; 311; 411) that is accommodated in a circumferential groove (13; 316) formed inside the female part (11; 317), the ring being closed, being made of elastomeric material, and being accommodated in the groove (13; 316).

9 Claims, 4 Drawing Sheets

PRESS-STUD

BACKGROUND OF THE INVENTION

The present invention relates to a press-stud.

Conventional press-studs constituted by a male part that detachably couples to a female part, the basic structure whereof is shown in the accompanying FIGS. 1 and 2 for the sake of clarity, are currently widely used in the field of clothing and in other fields in which it is necessary to join fabrics made of the most disparate materials.

In particular, the female part, generally designated by the reference letter A, comprises a hollow body B that has openings C and D respectively for the insertion of the male part, not shown, and of the means for anchoring to the fabric, which are also not shown.

A circumferential groove E obtained by bending is formed in the hollow body B and loosely accommodates an elastic split ring F made of metallic material.

The split ring F is the actual element for retaining the male part; said ring, by being split, can in fact expand so as to allow access of the anchoring end of the male part and then close at a circumferential slot formed in said male part proximate to the anchoring end.

Although this solution achieves its intended task, it is not free from drawbacks.

One of the main drawbacks is due to the fact that the clearance between the groove E formed in the metallic body B and the split ring F, which is also metallic, allows said ring to move and produce unpleasant noises (metallic jingling) when the press-stud is in the open configuration.

These noises are moreover unacceptable in quality clothing and are in any case not welcome in clothing items in general.

From FR-A-1,597,718 it is known a press-stud as defined in the preamble of claim 1.

SUMMARY OF THE INVENTION

A principal aim of the present invention is to provide a press-stud that solves the drawbacks noted above in the conventional ones, particularly eliminating in a substantially definite way the problem of metallic jingling and in any case of any noise caused by the knocking of parts in any state of said press-stud.

Accordingly, an important object of the present invention is to provide a press-stud the costs whereof are competitive with respect to the conventional ones.

Another object of the present invention is to provide a press-stud that can be easily mass-produced.

Another object of the present invention is to provide a press-stud which is simple in structure and does not require particular machining operations or the use of complex equipment.

Another object of the present invention is to provide a press-stud that can be easily adapted to the various aesthetic requirements of the most disparate fields of application.

Another object of the present invention is to provide a press-stud the functionality whereof is competitive with respect to the conventional ones, without requiring the user to perform particular physical efforts in closing and opening it.

This aim, these objects, and others which will become apparent hereinafter are achieved by a press-stud as defined in claim 1.

BRIEF DESCRIPTION OF THE DRAWINGS

Further characteristics and advantages of the present invention will become apparent from the following detailed description of five embodiments thereof and from its comparison with the structure of conventional press-studs, illustrated in the accompanying drawings, wherein.

DESCRIPTION OF THE PREFERRED EMBODIMENTS

Figure 1:
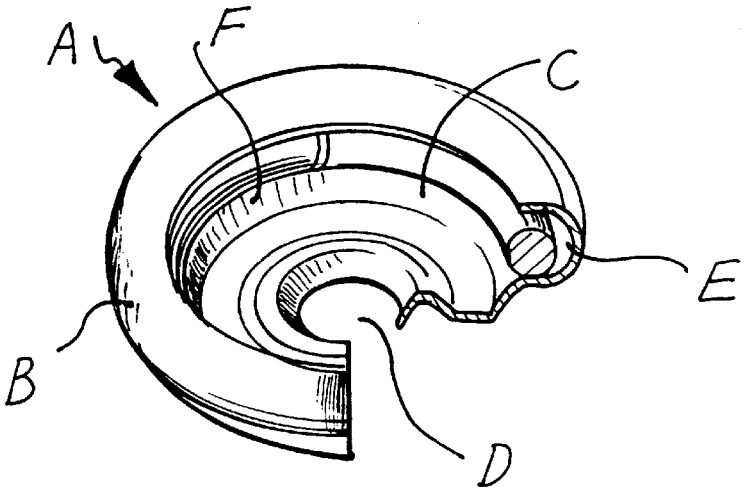
FIGS. 1 and 2 are views of a basic structure of the female part in conventional press-studs.
Figure 2:
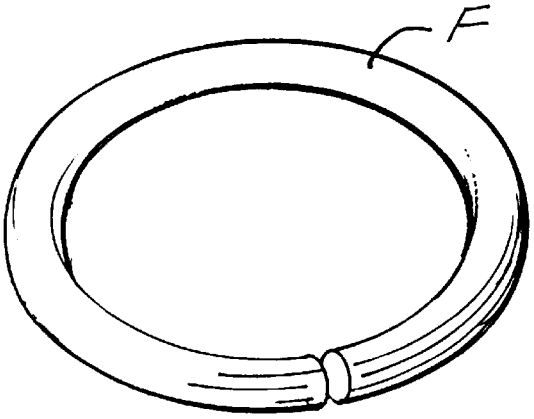
Figure 3:
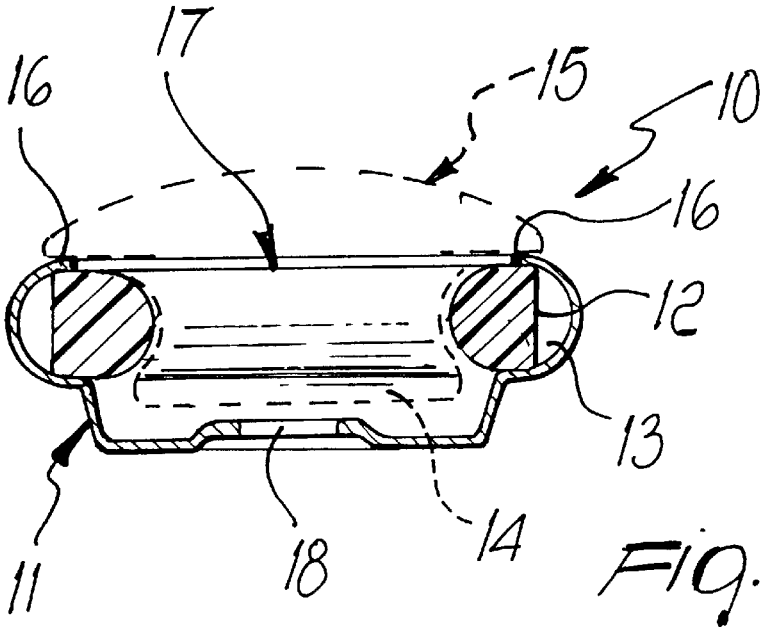
FIG. 3 is a sectional orthographic projection view of the female part, with the male part shown in dashed lines, of a press-stud according to a first embodiment of the present invention.
Figure 4:
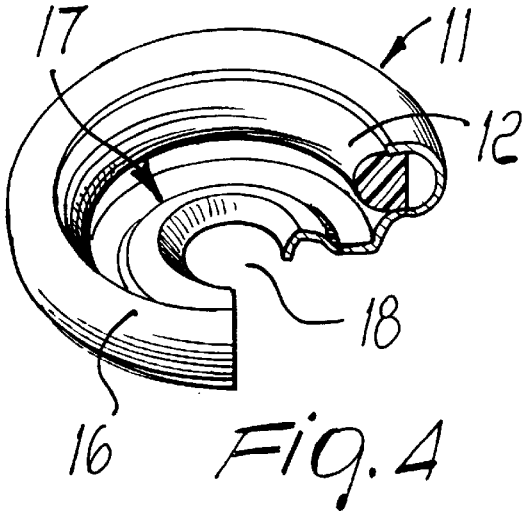
FIG. 4 is a partially sectional perspective view of the female part of the press-stud of FIG. 3.
Figure 5:
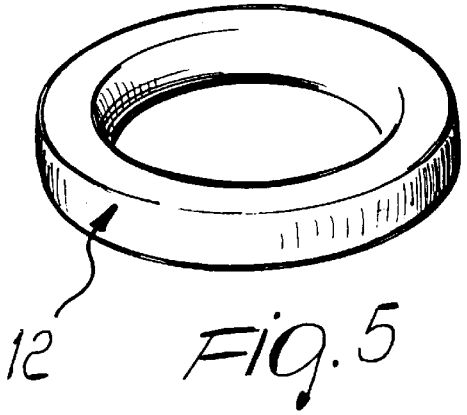
FIG. 5 is a perspective view of a detail of the press-stud of FIG. 3.

With particular reference to FIGS. 3 to 5, a press-stud according to the invention is generally designated by the reference numeral 10 in a first embodiment.

The press-stud 10 comprises a female part 11, to which one end 14 of a male part 15, shown in dashed lines in FIG. 3, is anchored in the closed configuration by forcing and elastically deforming a ring 12 that is accommodated in a groove 13 lying circumferentially with respect to said female part 11.

The ring 12 is closed and in this case is made, for example, of nylon.

In this embodiment, the ring 12 has a D-shaped cross-section; moreover, the portion of its surface that relates to the curved part of its cross-section, which is directed inwards, interferes with the end 14 of the male part 15.

In this case, the ring 12 is locked within the groove 13.

More specifically, the groove 13 has a substantially semi-circular transverse profile, except for an annular region 16 that is folded inward and forms, in the female part 11, an opening 17 for the access of the male part 15 and actually locks said ring 12.

A through hole 18 is furthermore formed in the female part 11 and lies opposite to the opening 17; said hole is adapted for the insertion and anchoring of the means for fixing the female part 11 to the fabric, which are not shown in the figures.

Figure 6:
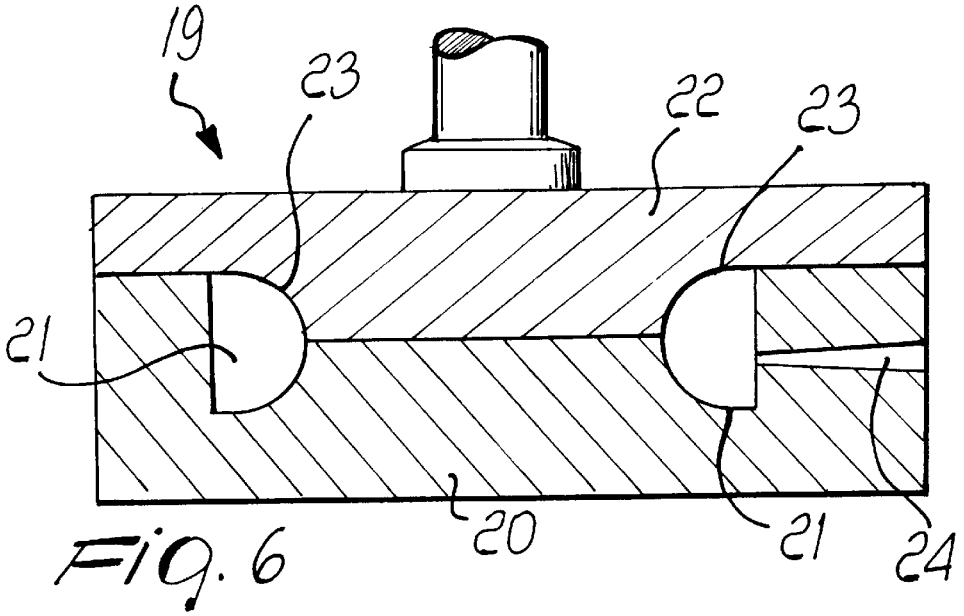
FIG. 6 is an elevational lateral view of the cross-section of a mold for forming the detail of FIG. 5.

With particular reference to FIG. 6, a mold particularly adapted for forming the ring 12 with a D-shaped cross-section is shown and is generally designated by the reference numeral 19.

The mold 19 comprises a fixed lower half mold 20, in which a circular impression 21 is formed; its surface contributes to form the corresponding surface of the element 12 that corresponds to the straight portion and to the lower half of the curved portion of the transverse cross-section.

The mold 19 furthermore comprises a movable upper half mold 22, in which an impression 23 is provided that cooperates to form the remaining contour of the outer surface of the ring 12 that corresponds to the upper half of the curved portion of the transverse cross-section.

An injection-molding passage 24 is also formed in the lower half mold 20.

The particular configuration of the impressions of the mold 19 causes the formed ring 12 to always remain "attached" to the lower half mold 20, after injection has occurred, when the upper half mold 22 is opened; in this manner it is sufficient to provide extractors, not shown, only in said lower half mold 20.

Figure 7:
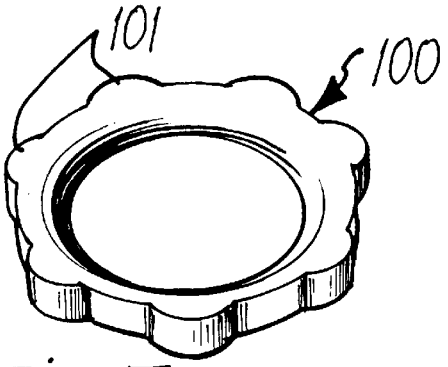
FIG. 7 is a perspective view of a detail of a press-stud according to a second embodiment of the present invention.

With particular reference to FIG. 7, a press-stud according to an embodiment of the invention, in a second embodiment, has a structure that is generally similar to the one of the first embodiment, to which reference is made for a more detailed description, except for the ring that retains the male part during closure, which in this case is designated by the reference numeral 100.

In this second embodiment, the portion of the circumferential surface of the ring 100 that is directed outwards is shaped so as to form protrusions 101 that protrude radially outwards and are equidistant.

Figure 8:
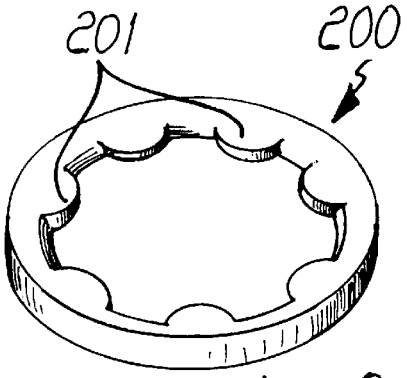
FIG. 8 is a perspective view of a detail of a press-stud according to a third embodiment of the present invention.

With particular reference to FIG. 8, a press-stud according to an embodiment of the invention, in a third embodiment, has a structure which is generally similar to the first embodiment, to which reference is made for a more detailed description, except for the ring that retains the male part during closure, which in this case is designated by the reference numeral 200.

In this third embodiment, the portion of the circumferential surface of the ring 200 that is directed inwards is shaped so as to form protrusions 201 that protrude radially inwards and are equidistant.

Figure 9:
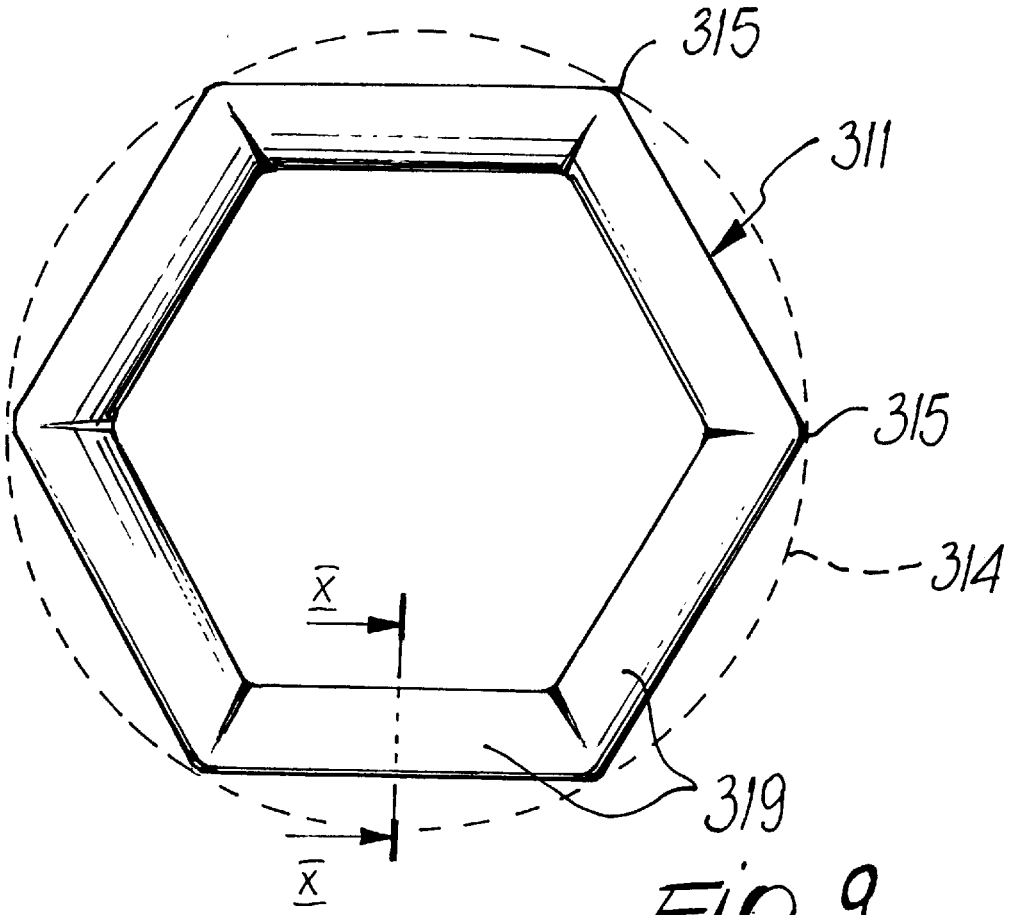
FIG. 9 is a plan view of a detail of a press-stud according to a fourth embodiment of the present invention.
Figure 10:
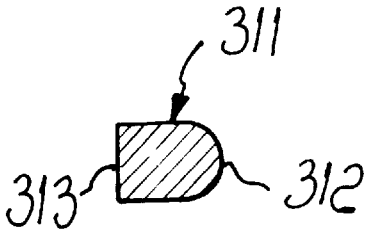
FIG. 10 is a sectional view of a detail of a press-stud according to the fourth embodiment of the present invention, taken along the plane X—X of FIG. 9.
Figure 11:
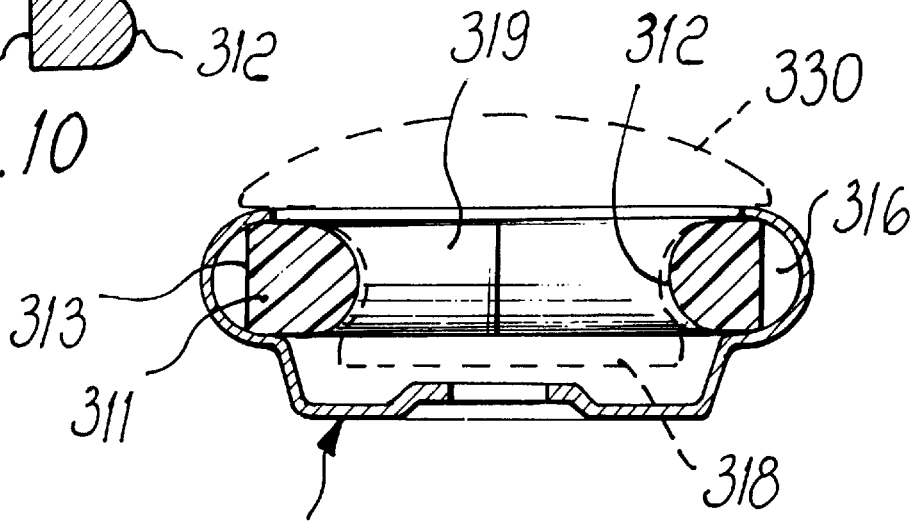
FIG. 11 is a sectional lateral view of the female part, with the male part in dashed lines, of a press-stud according to the fourth embodiment of the invention.

With particular reference to FIGS. 9 to 11, a press-stud according to and embodiment of the invention, in a fourth embodiment, comprises an elastic element that is constituted by a closed ring 311 made of elastomeric material which has a polygonal and preferably hexagonal shape.

Its cross-section is advantageously D-shaped, with an inner rounded part 312 and an outer flat part 313.

Nylon or a similar material is preferred among elastomers.

In FIG. 9, the circle 314 drawn in dashed lines has been traced to point out the regions of the corners 315 by means of which the ring 311 can rest against the groove 316 of the female part 317 in which it is accommodated.

When the end 318 of the male part 330 is inserted, the sides 319 deform by flexing, allowing its passage; said flexural deformation is optionally combined with an elastic elongation of the ring 311.

Figure 12:
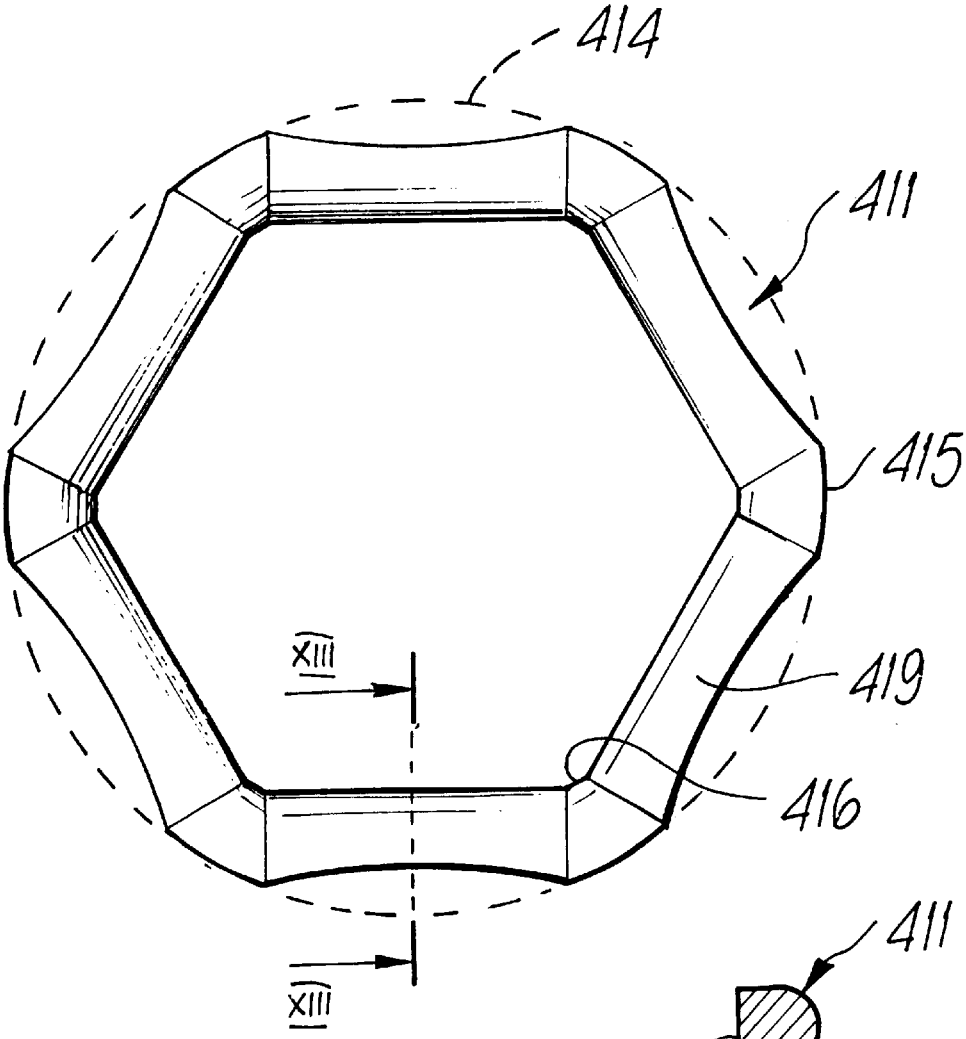
FIG. 12 is a plan view of a detail of a press-stud according to a fifth embodiment of the present invention.
Figure 13:
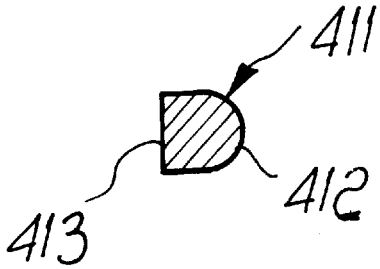
FIG. 13 is a sectional view, taken along the plane XIII—XIII of FIG. 12, of a detail of a press-stud according to the fifth embodiment of the invention.
Figure 14:
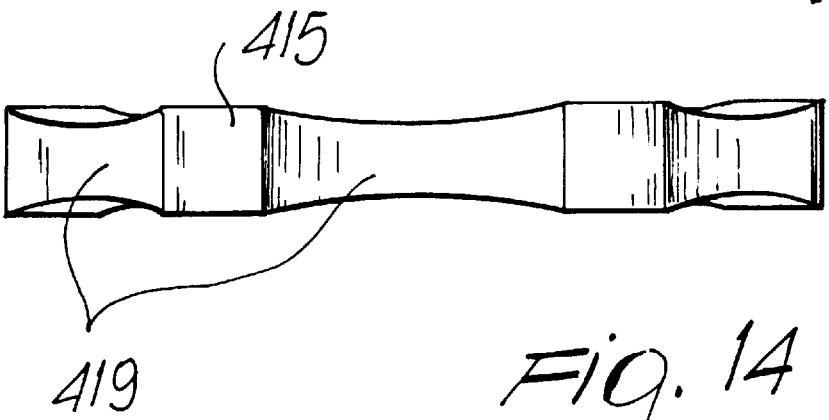
FIG. 14 is a side view of a detail of a press-stud according to the fifth embodiment of the invention.

With reference to FIGS. 12 to 14, a press-stud according to an embodiment of the invention, in a fifth embodiment, comprises an elastic element that is constituted by a closed elastomeric ring 411 having a substantially polygonal shape.

The surface portion of the ring 411 that is directed inwards is substantially hexagonal and forms internal corners 416.

The surface portion of said ring 411 that is directed outwards is shaped so as to form node-like protrusions 415 that are equidistant and protrude outwards at the corners 416 of the hexagon of the internal surface.

The cross-section is advantageously D-shaped, with the rounded part 412 on the inside and the flat part 413 on the outside.

Said protrusions 415, as pointed out by the circle 414 traced in dashed lines, form the regions by means of which the ring 411 can rest against the groove of the female part in which it is accommodated.

At the same time, the internal hexagon reduces the retention surface when the male part is in the closure step.

Accordingly, when the male part is inserted, the sides 419 undergo a flexural deformation that allows said male part to pass; said deformation is optionally combined with an elastic elongation of the ring 411.

Said sides 419 for connecting the node-like protrusions 415 have a variable cross-section, so that they are thinner in the central part and stronger at said protrusions 415.

In practice it has been observed that the present invention has achieved the intended aim and objects.

In particular, it should be noted that the various materials constituting said ring and the body of the female part fully eliminate the problem of unpleasant noises both when the press-stud is closed and when it is open.

Furthermore, the structure of the press-stud according to the invention is very simple from the production viewpoint and does not entail particular complications in the operations required to produce it.

Accordingly, the press-stud according to the invention achieves production costs and machining times that are highly competitive with respect to the conventional ones.

Furthermore, the press-stud according to the invention, by using the intrinsic flexibility of elastomers (nylon or equivalent materials), allows the operations for closing and opening the female part and the male part to be easy and gentle, despite ensuring good retention and functionality in general.

The present invention is susceptible of numerous modifications and variations, all of which are within the scope of the appended claims; thus, for example, the cross-section of the ring may be circular and the protrusions can be formed simultaneously outward and inward.

What is claimed is:

1. A press-stud comprising a female part to which one end of a male part is anchored in a closed configuration by forcing with elastic deformation of a ring that is accommodated in a circumferential groove formed inside said female part, wherein said ring is closed, has a polygonal inner perimeter is made of elastomeric material, the surface portion of said ring that is directed inwards being polygonal and forming corners, the surface portion that is directed outwards being shaped so as to form protrusions that extend radially at said corners.

2. The press-stud according to claim 1, wherein said ring rests in said groove of the female part only with said protrusions defined that extend radially at the corners of the perimeter of said ring.

3. The press-stud according to claim 1, wherein said ring has a D-shaped cross-section, the surface portion that relates to the curved portion of the cross-section being directed inwards and interfering with said end of said male part.

4. The press-stud according to claim 3, wherein said ring has a D-shaped cross-section in which the inner edge is curved and the outer edge is flat.

5. The press-stud according to claim 1, wherein said ring is locked inside said groove.

6. The press-stud according to claim 1, wherein the surface of said groove has a semicircular transverse profile, except for an annular region folded inwards and forming, in said female part, an access opening for said male part and locking said ring.

7. The press-stud according to claim 1, wherein said ring having a polygonal inner perimeter is hexagonal.

8. The press stud according to claim 1, characterized in that said ring having a polygonal inner perimeter has a polygonal outer perimeter.

9. The press-stud according to claim 1, wherein said inner perimeter is hexagonal.

* * * * *